US006368694B1

(12) United States Patent
Marsh et al.

(10) Patent No.: US 6,368,694 B1
(45) Date of Patent: Apr. 9, 2002

(54) CABINET CORNER PROTECTION

(75) Inventors: Thomas R. Marsh; Robert C. Hightower, both of High Point, NC (US)

(73) Assignee: Tenn-Tex Plastics, Inc., Colfax, NC (US)

( * ) Notice: Subject to any disclaimer, the term of this patent is extended or adjusted under 35 U.S.C. 154(b) by 0 days.

(21) Appl. No.: 09/476,173

(22) Filed: Dec. 30, 1999

Related U.S. Application Data

(60) Provisional application No. 60/117,216, filed on Jan. 25, 1999.

(51) Int. Cl.[7] ..... B32B 3/06

(52) U.S. Cl. ..... 428/99; 428/122; 206/453; 206/586; 229/199

(58) Field of Search ..... 428/99, 122; 206/586, 206/453; 229/199, 198.1

(56) References Cited

U.S. PATENT DOCUMENTS 5,033,669 A * 7/1991 Federico ..... 229/199
5,037,027 A * 8/1991 Nichols ..... 229/199

* cited by examiner

*Primary Examiner*—Alexander S. Thomas
(74) *Attorney, Agent, or Firm*—Myers Bigel Sibley & Sajovec

(57) ABSTRACT

A corner protector useful for shielding the corner of a cabinet from damage during shipping, storage, handling or the like, comprises a top member having an outer portion, an inner portion, and a generally flat planar bottom portion. A first pair of arm members is connected to the top member outer portion and projects downward therefrom, with the first pair of arm members being positioned substantially perpendicularly to one another, each of the first arm members having a generally flat planar bottom edge portion oriented substantially parallel with one another and substantially parallel with the top member bottom portion. A second pair of arm members is connected to the top member inner portion and projects downward therefrom, with each member of the second pair of arm members facing a corresponding member of first pair of arm members, each of the second pair of arm members having a generally flat planar bottom edge portion oriented substantially parallel with one another and substantially parallel with the top member bottom portion. The second arm member bottom portions are spaced downward from the first arm member bottom portions so that the corner protector can be easily installed by hand on a cabinet corner to shield the corner from damage.

22 Claims, 9 Drawing Sheets

CABINET CORNER PROTECTION

RELATED APPLICATIONS

This application claims priority from U.S. Provisional Application Ser. No. 60/117,216, filed Jan. 25, 1999, the disclosure of which is incorporated by reference herein in its entirety.

FIELD OF THE INVENTION

The present invention relates to corner protectors useful for shielding the corners of cabinetry and the like during shipping, storage and handling.

BACKGROUND OF THE INVENTION

Wood cabinetry, particularly cabinetry for home and kitchen installation, is manufactured in part and then shipped to the location in which it is installed. Often the cabinetry is shipped to a central storage location or vendor prior to delivery to the customer, or end user, for installation. The cabinetry can be damaged at any point in the distribution process. If damage occurs, the entire cabinet must be replaced, or a substitute part must be delivered and the cabinet repaired on site. Either choice is expensive and time consuming. Accordingly, the top and bottom corners of cabinets are particularly susceptible to damage, and are usually shielded by some sort of corner protector. Such protectors are removed and discarded when the cabinetry is delivered for installation.

Corner protectors should be distinguished from cabinet corner braces. A corner brace is installed permanently in the interior corner of a cabinet to rigidify the cabinet. Unlike corner protectors, corner braces have been highly developed. For example, many cabinets are shipped without a top so that the consumer is then able to install any of a variety of different tops of their choice on the cabinet. Since the interior shelf is shipped with the cabinet, corner braces have been designed to carry the interior shelf thereon (further rigidifying the cabinet during shipping) for subsequent removal and installation within the cabinet prior to installation of the top. See T. Marsh, U.S. Pat. No. 5,312,078. Such corner braces do not protect the exterior corner of the cabinet from damage.

Current corner protectors are rudimentary in nature, and typically formed of corrugated paper or plastic. Such corner protectors must be fastened in place with staples or the like, or held in place by the outer packaging (corrugated cardboard, shrink-wrap packaging, etc.) of the cabinetry. Comer protectors that include some sort of means for engaging the corner are not currently available.

SUMMARY OF THE INVENTION

Accordingly, a first object of this invention is to provide a means for protecting cabinet corners during shipping, storage, handling and the like.

A second object of the invention is to provide a cabinet corner protector which incorporates a means for securing the protector to the cabinet without the need for stapling, external wrapping, or the like.

A third object of the invention is to provide a cabinet corner protector which can be quickly and easily installed at the manufacturing plant for shipping of the cabinet.

In addition, since cabinet corners are frequently formed from side materials of two different thicknesses (e.g., the front wood being thicker than the side material), it is optionally preferred to provide a corner protector that can easily be installed on a corner formed from sides of two different thicknesses.

In view of the foregoing, a first aspect of the present invention is a corner protector useful for shielding the corner of a cabinet from damage during shipping, storage, handling or the like. The corner protector comprises:

(a) A top member having an outer portion, an inner portion, and a substantially flat planar bottom portion (b) A first pair of arm members connected to the top member outer portion and projecting downward therefrom. The first pair of arm members are positioned substantially perpendicularly to one another. Each of the first arm members has a generally flat planar bottom edge portion oriented substantially parallel with one another, and substantially parallel with the top member bottom portion.

(c) A second pair of arm members connected to the top member inner portion and projecting downward therefrom. Each member of said second pair of arm members faces a corresponding member of said first pair of arm members. Each of the second pair of arm members has a generally flat planar bottom edge portion oriented substantially parallel with one another, and substantially parallel with said top member bottom portion.

The second arm member bottom portions are spaced downward from the first arm member bottom portions so that the corner protector can be easily installed by hand in a simple, rapid, forward-sweeping motion on a cabinet corner to shield the corner from damage. Preferably, one of the first or second pair of arm members are rigid arm members, and with the other of said first or second pair of arm members are resilient arm members, so that said resilient arm members engage the cabinet corner in a clamping or spring-like manner after installation thereon.

In one embodiment of the foregoing, the corner protector further comprises:

(d) A shelf member interconnecting the second pair of arm members, the shelf member having a generally flat planar top portion oriented substantially parallel with the second arm member bottom portions.

(e) A frangible junction interconnects the second pair of arm members to the top portion.

The second pair of arm members and the shelf portion together form a corner brace member which can be fastened to the cabinet corner after installation of the corner protector, so that the top portion and the first arm members can together be separated from the corner brace to leave the cabinet corner unshielded and the corner brace installed in the cabinet.

The present invention is explained in greater detail in the detailed description and drawings set forth below.

DETAILED DESCRIPTION OF PREFERRED EMBODIMENTS

Figure 1:
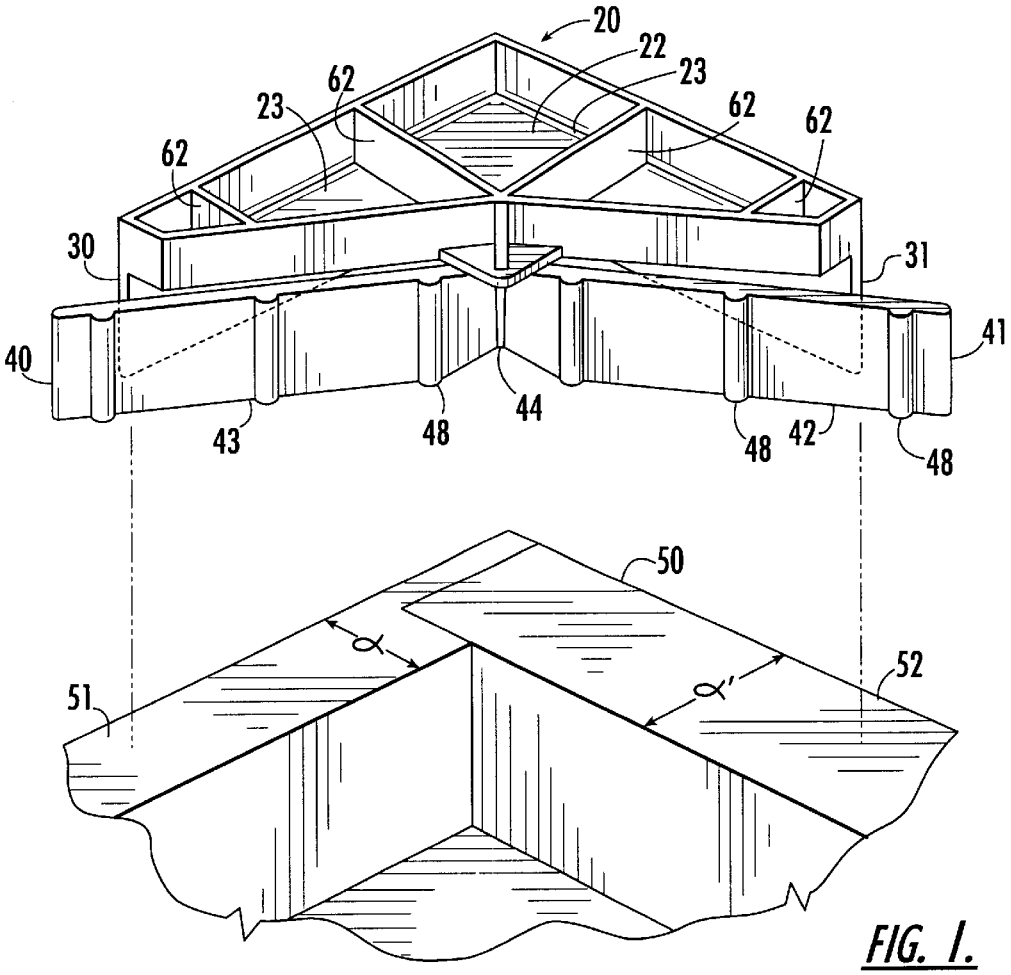
FIG. 1 is a perspective view of a corner protector of the invention, prior to being installed on a cabinet corner.
Figure 2:
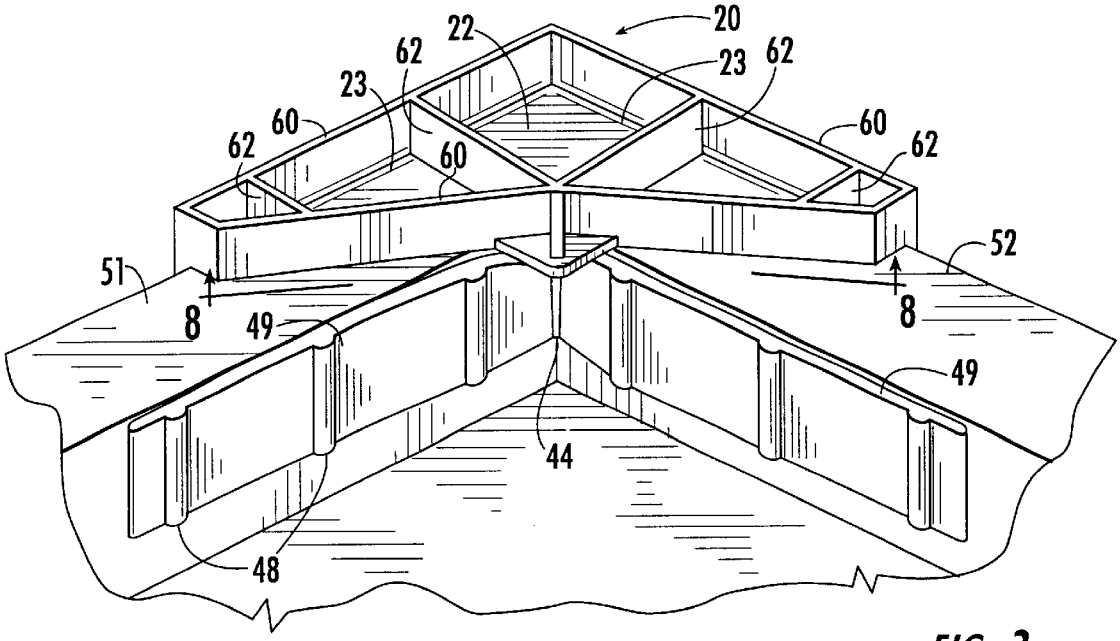
FIG. 2 is a perspective view of a corner protector of the invention installed on a cabinet corner.
Figure 3:
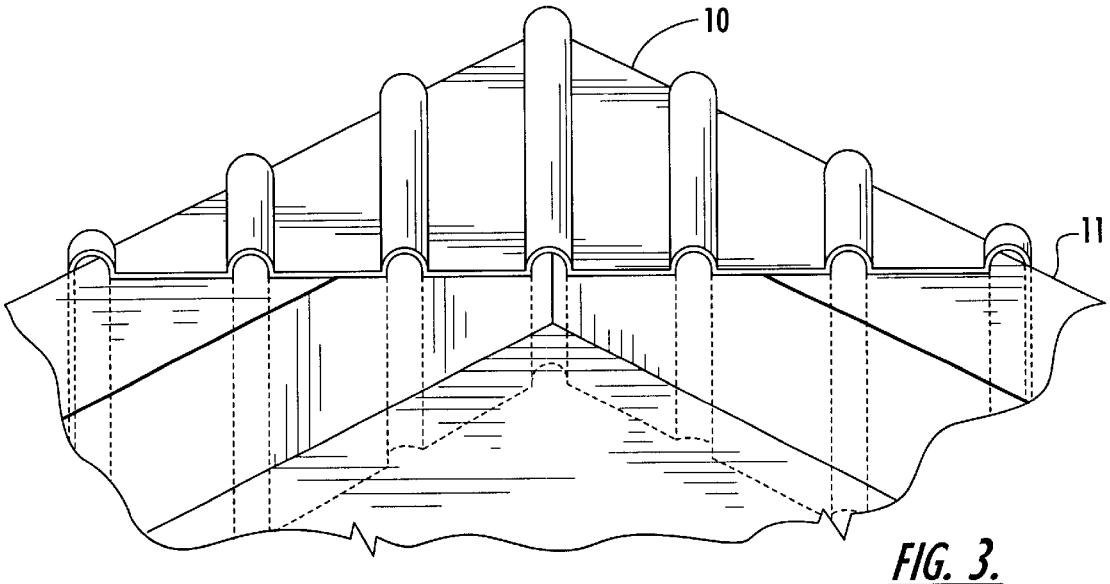
FIG. 3. (PRIOR ART)
FIG. 3 is a perspective view of a prior art corrugated corner protector resting on a cabinet corner.
Figure 4:
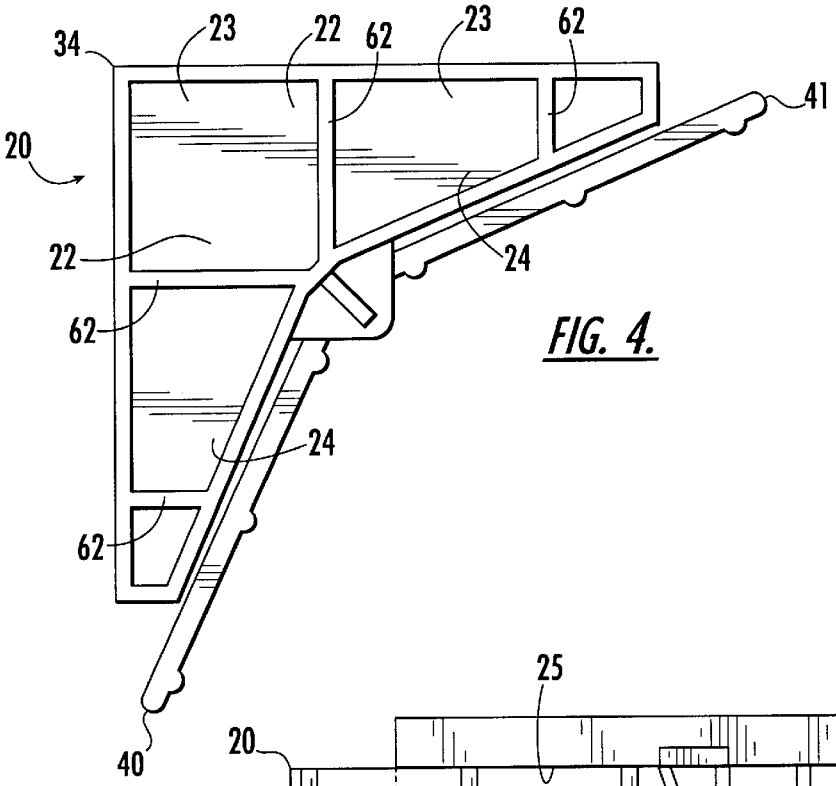
FIG. 4 is a top view of a corner protector of FIG. 1.

FIG. 3 is a perspective view of a prior art corrugated corner protector 10 resting on a cabinet corner 11. Note the absence of any means incorporated into the corner protector itself for securing the corner protector to a cabinet.

A preferred embodiment of the present invention is illustrated both on and off a cabinet corner in FIGS. 1–2 and FIGS. 4–5. As illustrated,a corner protector 20 of the invention comprises a top member 22 having an outer portion 23, an inner portion 24, and a generally flat planar bottom portion 25 (some parts are better viewed in FIGS. 6–8, which are discussed in greater detail below). A first pair of arm members 30, 31 is connected to the top member outer portion and projects downward therefrom, with the first pair of arm members being positioned substantially perpendicularly to one another. Note that each of the first arm members has a generally flat planar bottom edge portion 32, 33 oriented substantially parallel with one another, and substantially parallel with the top member bottom portion. The two arm members join at an apex portion 34.

A rigid post 44 is connected to the top member bottom portion 25 at a position spaced apart from each member of the first pair of arm members 30, 31, and projects downward from the bottom portion 25. Preferably, the rigid post is connected to the bottom portion at a position facing the apex portion 34 of the first two arm members, and is substantially equally spaced apart from each of the first two arm members as shown. A second pair of arm members 40, 41 is connected to the rigid post and project outward therefrom. Note that each member of the second pair of arm members faces a corresponding member of first pair of arm members. In the illustrated embodiment, the first arm members are substantially rigid, and the second arm members are relatively resilient, flexing at their point of attachment to the post. Each of the second pair of arm members is positioned at an obtuse angle to one another to provide, together with the resiliency thereof and in combination with the rigidity of the corresponding, opposite facing, arm member, an adjustable clamping mechanism for engaging the side member of the corner that is abutted by the opposite facing arm member. Since each resilient arm member has a range of resiliency over several degrees of travel, the resilient arm member is capable of engaging several thicknesses of side members. This is highly advantageous because many corners are formed from two sides (or more correctly, front and side portions, or back and side portions) of different thickness, and there is little standardization of thicknesses in the industry. Hence, the provision of a corner protector that can engage a variety of side thicknesses reduces the need to provide a variety of different corner protectors for cabinets formed of different thickness materials.

Figure 5:
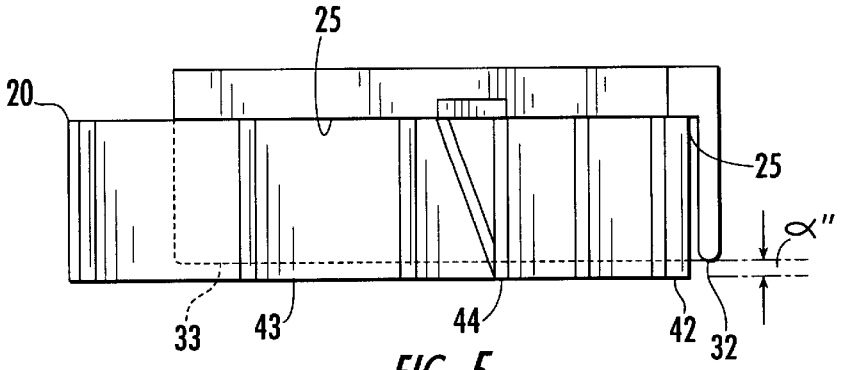
FIG. 5 is a side view of a corner protector of FIG. 1.
Figure 6:
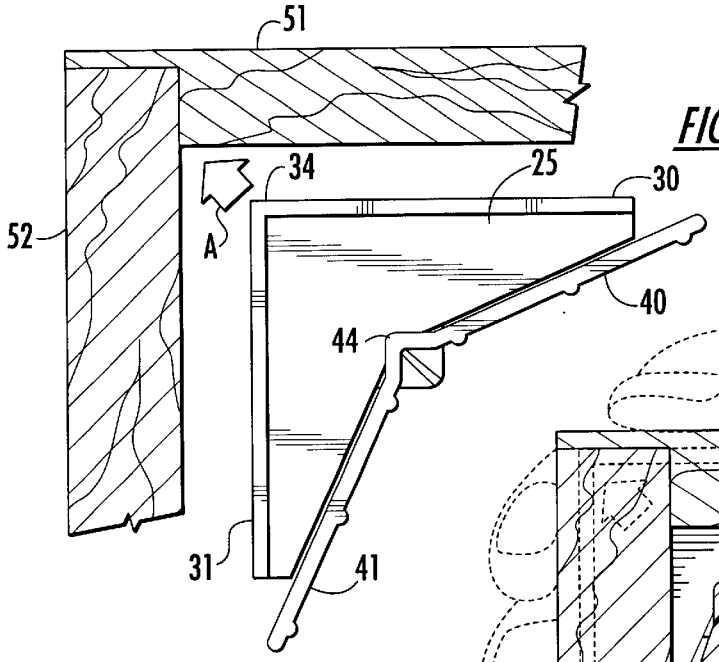
FIG. 6 is a bottom view of a corner protector of the invention, prior to being installed on a cabinet corner.
Figure 7:
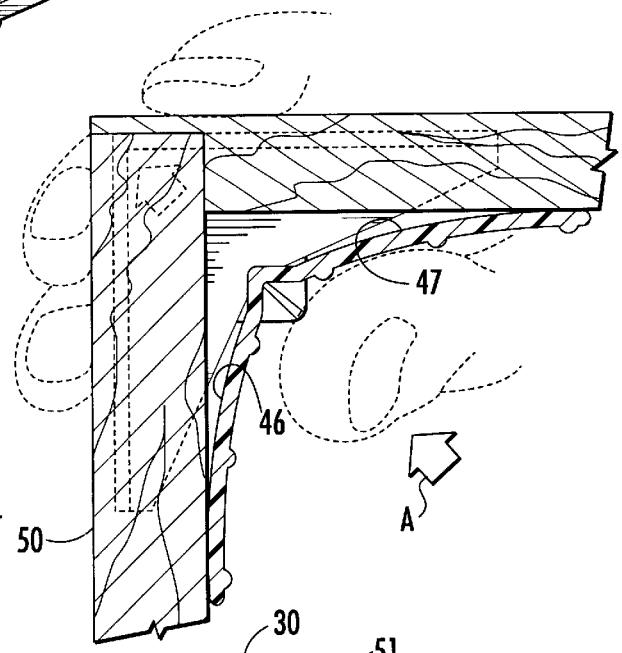
FIG. 7 is a bottom view of a corner protector of the invention, in the process of being installed on a cabinet corner.
Figure 8:
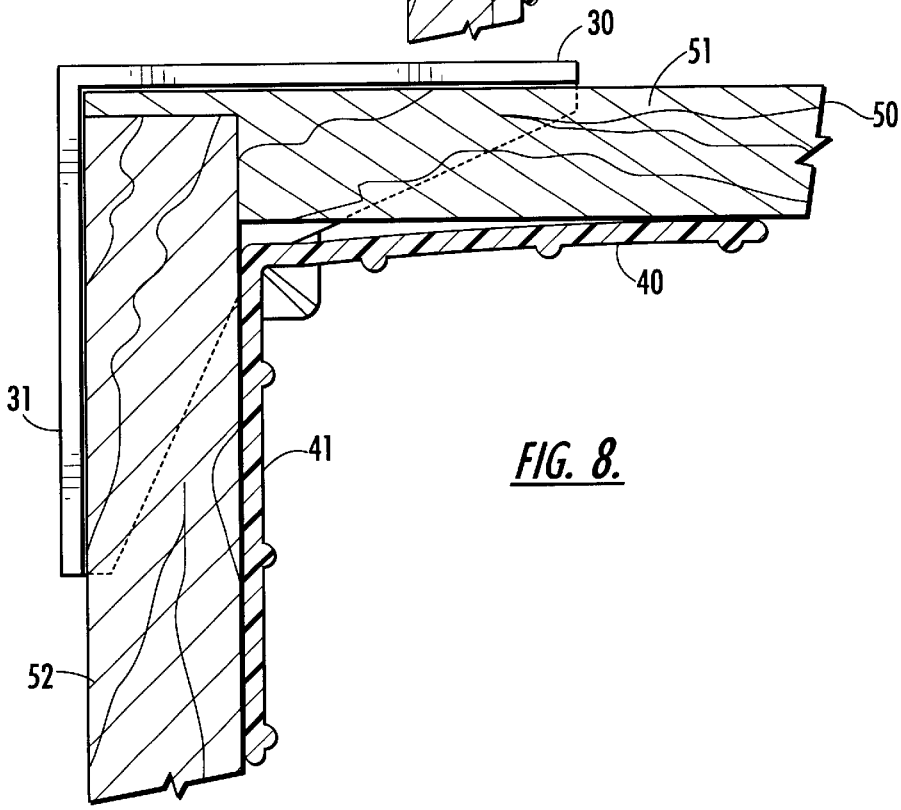
FIG. 8 is a bottom view of a corner protector of the invention, after being installed on a cabinet corner.

Each of the second pair of arm members has a generally flat planar bottom edge portion 43, 44 oriented substantially parallel with one another and substantially parallel with the top member bottom portion. As best illustrated in FIGS. 6–8, the second arm member bottom portions 43, 44 are spaced downward from the first arm member bottom portions 33, 34 so that the corner protector can be easily installed by hand on a cabinet corner to shield the corner from damage. FIG. 6 is a bottom view of a corner protector of the invention, prior to being installed on a cabinet corner, with an arrow A indicating the direction of travel during installation. FIG. 7 is a bottom view of a corner protector of the invention, in the process of being installed on a cabinet corner 50, with arrows A indicating the direction of travel during installation and the human hand shown in phantom view illustrating the ease by which the installation is accomplished. Because, as best seen in FIG. 5, the bottom edge portions 42, 43 of the second arm members extend below the bottom edge portions 32, 33 of the first arm members, the first arm members will slide across the top portion of the corner until they are engaged by the downward projecting faces of the 46, 47 of the second arm members, upon which the second arm members flex backward. Slight downward pressure by hand while the corner corner is being slide across the corner in the direction of arrows will then cause the corner protector to fall into and clamp into place when the forward arm members 31, 32 extend over the sides 51, 53, achieving the configuration shown in FIG. 8 (and FIG. 2) Note in FIGS. 2 and 8 the different thickness of the two side members 51, 52 of the cabinet, yet the securing of the corner protector to the cabinet corner.

Ridges 48 can be provided on the second arm members to strengthen the same. A top ridge or lip along the top surface portion 49 can be added in a preferred embodiment, at right angle to the arm members themselves, to further strengthen the resilient ridge. This feature is best illustrated as the top ridge 63 in FIG. 14, but in a preferred embodiment are provided in a corner bracket that does not incorporate the bumpers shown in that Figure and discussed below.

The corner protector illustrated include a ridge member 60 connected to the top member and projecting outward (or upward) therefrom, the ridge member configured to further shield the cabinet corner when installed thereon. The ridge 60 extends continuously around the entire peripheral edge portion of the top member. The provision of such a ridge is particularly helpful when the corner protector is a bottom corner protector because it spaces the cabinet from the floor, or where it is a top corner protector and the cabinet being protected may have other items stacked on top thereof. Reinforcing ribs 62 are included to reinforce the ridge 60. The reinforcing ribs 62 are the same height as the reinforcing ridge 60, and extend at right angles from the two portions of the reinforcing ridge above the first arm members at the top member outer portion 23, all the way across the top member, until they meet and join with the portion of ridge 60 that overlies the top member inner portion 24. This feature is also illustrated as the second ridge members 62' in FIG. 14, which also incorporates the bumpers discussed below, but in one preferred embodiment are provided in a corner bracket that does not incorporate such bumpers. As an alternative to reinforcing ridges, reinforcing angles that do not extend all the way across the top member, or other suitable rigidifying means, could also be employed.

Figure 9:
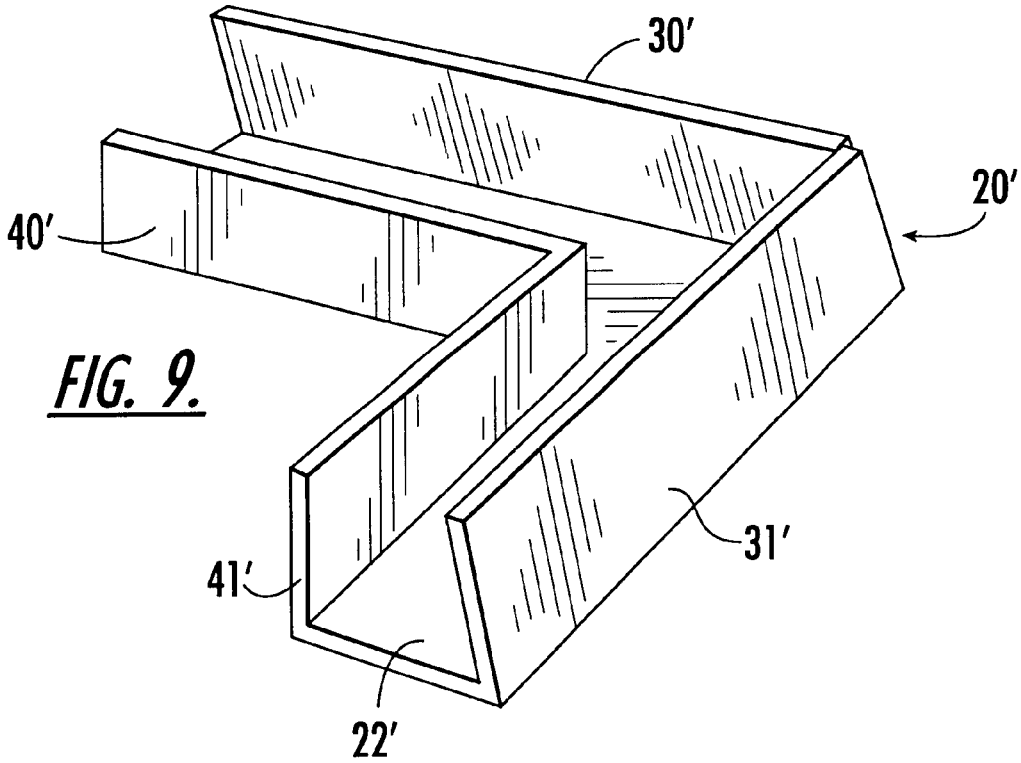
FIG. 9 is a perspective view of a second embodiment of a corner protector of the present invention.
Figure 10:
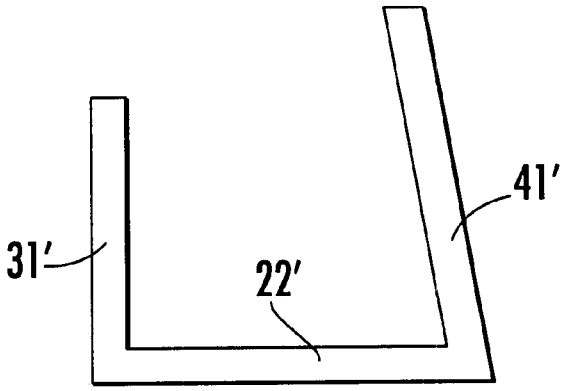
FIG. 10 is a cross-sectional view of one arm of the corner protector of FIG. 9.
Figure 11:
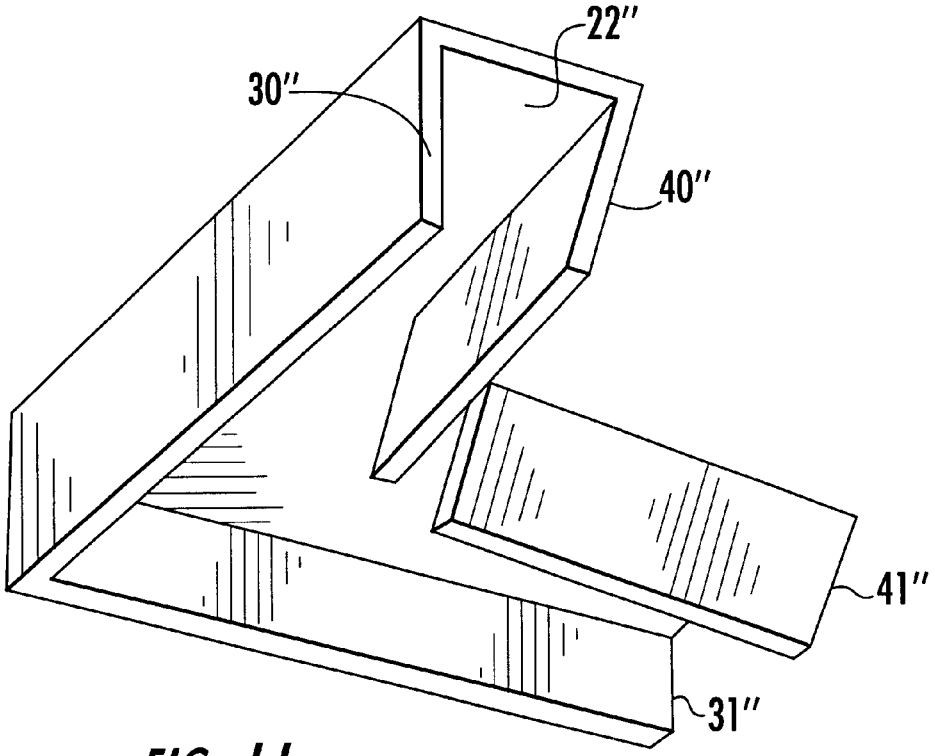
FIG. 11 is a perspective view of a third embodiment of a corner protector of the present invention.
Figure 12:
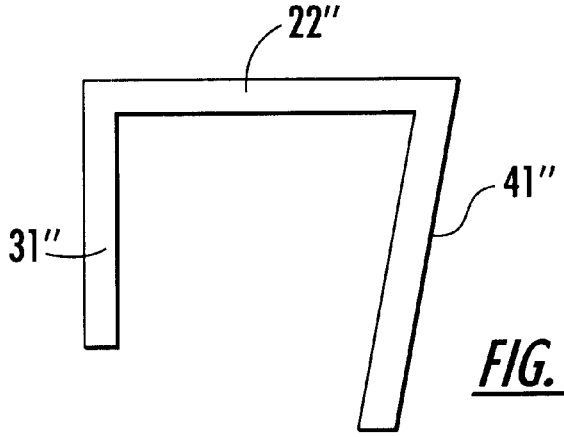
FIG. 12 is a cross-sectional view of one arm of the corner protector of FIG. 11.

The present invention can be embodied in a variety of different forms. For example, FIGS. 9–10 illustrates an additional embodiment of the invention, wherein the first pair of arm members 30', 31' are resilient arm members and the second pair of arm members 40', 41' are rigid arm members. FIGS. 11–12 illustrate an embodiment similar to FIGS. 9–10, except now the first pair of arm members 30", 31" are again rigid arm members, and the second pair of arm members 40", 41" are resilient arm members. In both embodiments, since the arm members that are resilient are joined to the top portion 22', 22" along a seam that flexes, the second pair of arm members are positioned substantially perpendicularly to one another.

Figure 13:
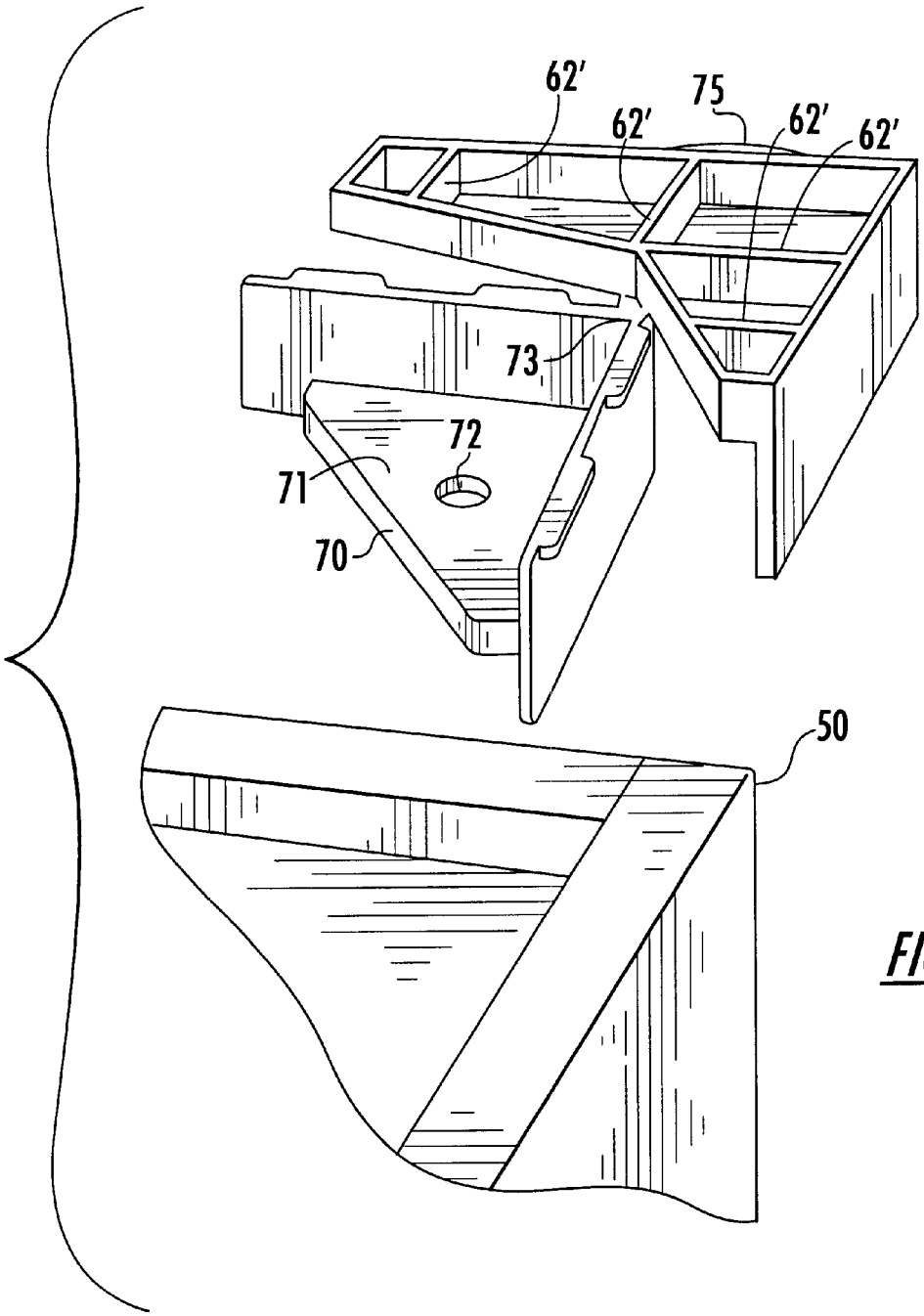
FIG. 13 is a perspective view of a third embodiment of the present invention, in which the corner protector incorporates a permanent corner bracket which remains in a cabinet top corner after the temporary protector is removed.

FIG. 13 illustrates a particular embodiment of the invention wherein the corner protector further comprises a shelf member 70 interconnecting the second pair of arm members. The shelf member having a generally flat planar top portion 71 oriented substantially parallel with the second arm member bottom portions, an opening 72, and a frangible junction portion 73 interconnecting the second pair of arm members to the top portion. The second pair of arm members and the shelf portion together form a corner brace member which can be fastened to said cabinet corner after installation of the corner protector, so that said top portion and the first arm members can together be separated from the corner brace at junction 73 to leave the cabinet corner unshielded and the corner brace installed in the cabinet. The corner brace can be constructed essentially as disclosed in U.S. Pat. No. 5,312,078 (the disclosure of which is incorporated herein by reference). It will be noted that the corner brace portion must be fastened into the cabinet corner by means such as staples, adhesive, or other fasterner, and that, since the second arm members are made rigid by the shelf member 70, such a combination corner protector and corner brace must either be designed to the specific thicknesses of the side sections of the cabinet, or the first arm members must be made resilient in the manner described in connection with FIGS. 9 and 10 above. The remainder forms a temporary corner protector 80 that protects the corner during shipping, but can be lifted up and broken off when desired.

Figure 14:
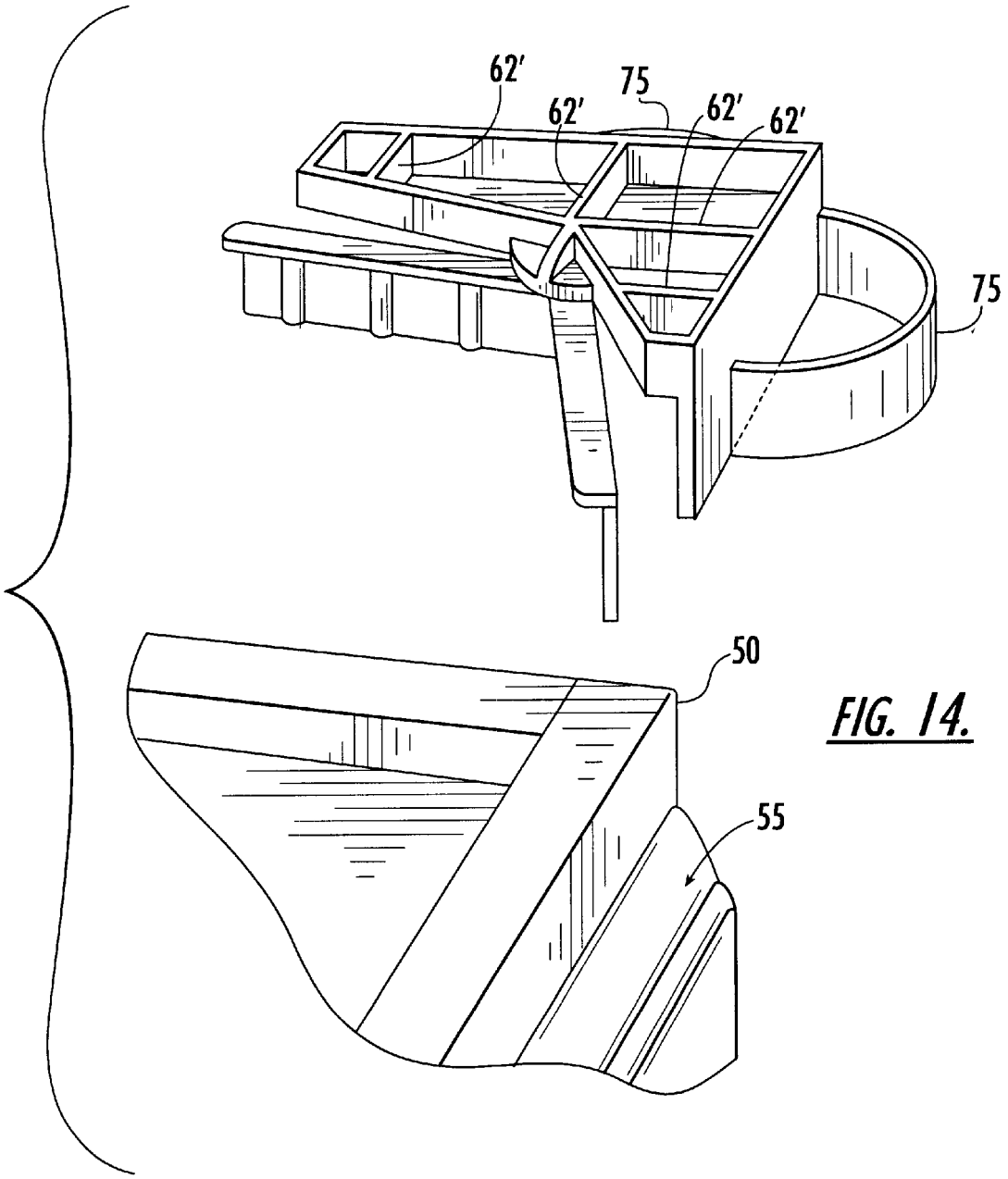
FIG. 14 is a perspective view of a fourth embodiment of the present invention, in which the corner protector incorporates extended bumpers to protect raised features of the cabinet, such as a door front.
Figure 15:
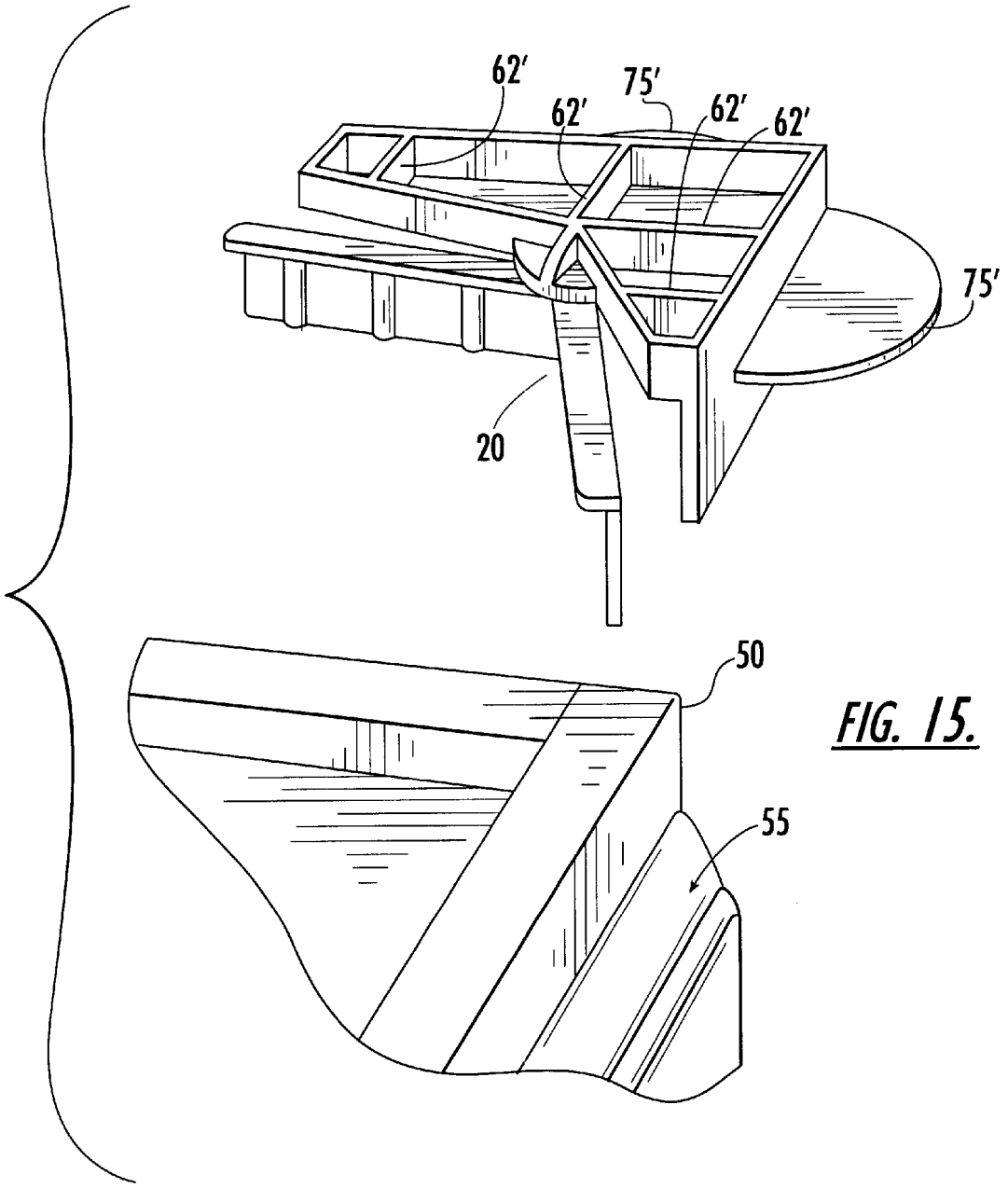
FIG. 15 is a perspective view of a fifth embodiment of the invention, in which the bumper is in the form of a disk.
Figure 16:
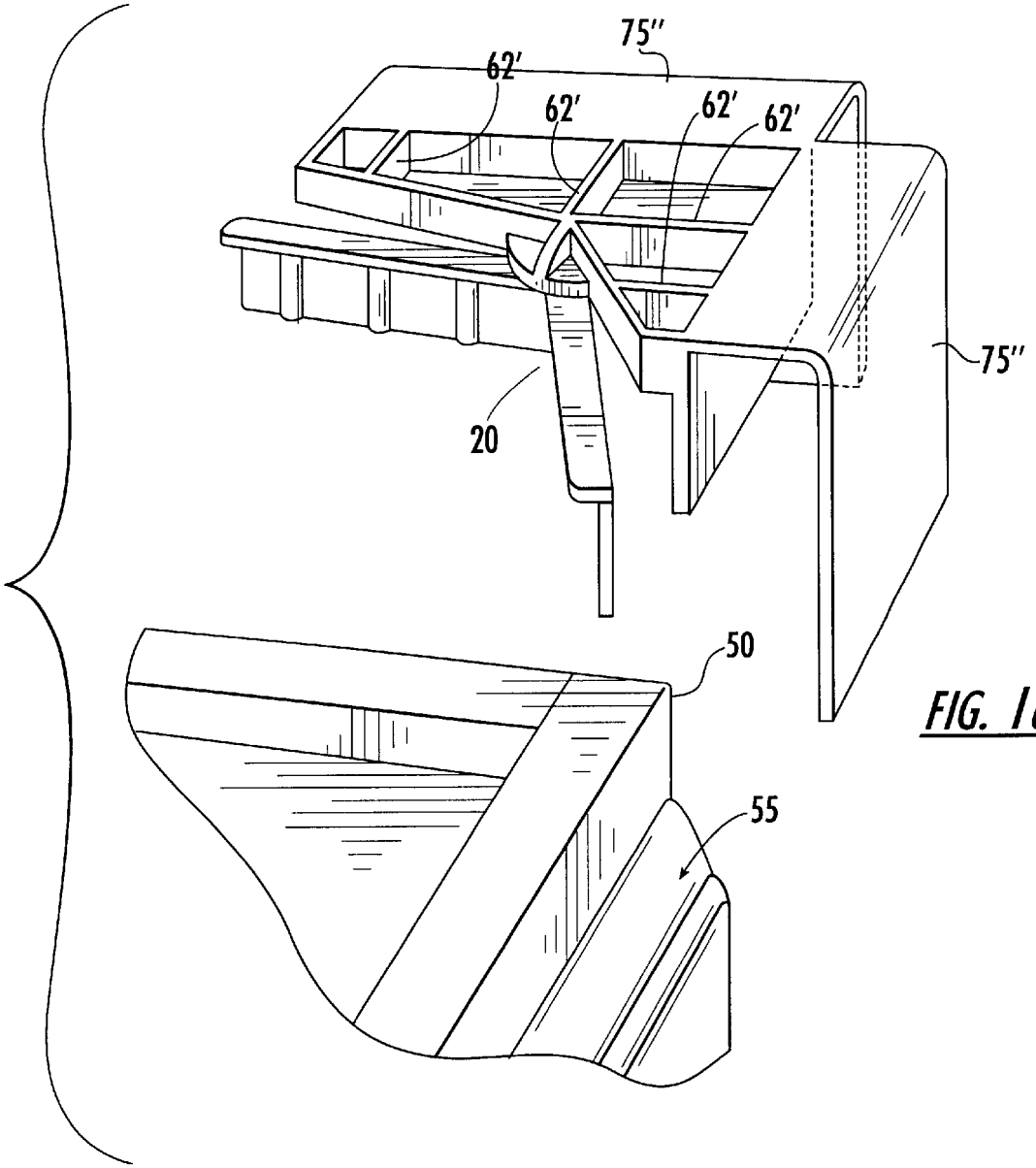
FIG. 16 is a perspective view of a sixth embodiment of the invention, in which the bumper has been extended on the front side to form a member that holds the door in place during shipping.

As shown in FIG. 14, the first arm members each have an outer portion, and the corner protector further comprises a bumper member 75 connected to one or both of the outer portions, the bumper members configured to further shield the cabinet corner (or extended elements of the cabinet itself, such as a door 55) when the protector is installed thereon, particularly at the top of a cabinet as illustrated. FIG. 15 is a perspective view of a fifth embodiment of the invention, in which the bumper 75' in the form of a disk. FIG. 16 is a perspective view of a sixth embodiment of the invention, in which the bumper 75" has been extended on the front side to form a member that holds the door in place during shipping.

Corner protectors of the invention may be formed of polymeric, typically thermoplastic, material, such as polystyrene and high impact polystyrene. The protector can be manufactured by injection molding in accordance with conventional techniques, so that the resulting part is a single integral unit of thermoplastic material.

While the present invention has been described above with respect to the corner protectors themselves and the cabinet being protected shown in partial view only, it will be appreciated that the present invention also may be viewed as the combination of a cabinet and a corner protector as described above, with the corner protector installed on the cabinet in the manner described above. A single protector or multiple protectors may be installed, along front and/or back, and along top and/or bottom corners, depending upon the features of the particular cabinet being protected. Wood cabinets are particularly suitable for protection with the corner protectors of the invention, particularly where the corner joins two sides of different thickness as explained above.

The foregoing is illustrative of the present invention, and is not to be construed as limiting thereof. The invention is defined by the following claims, with equivalents of the claims to be included therein.

We claim:

1. A corner protector useful for shielding the corner of a cabinet from damage, said corner protector comprising:

a top member having an outer portion, an inner portion, and a generally flat planar bottom portion;

a first pair of arm members connected to said top member outer portion and projecting downward therefrom, with said first pair of arm members being positioned substantially perpendicularly to one another, each of said first arm members having a generally flat planar bottom edge portion oriented substantially parallel with one another and substantially parallel with said top member bottom portion;

a second pair of arm members connected to said top member inner portion and projecting downward therefrom, with each member of said second pair of arm members facing a corresponding member of first pair of arm members, each of said second pair of arm members having a generally flat planar bottom edge portion oriented substantially parallel with one another and substantially parallel with said top member bottom portion;

said second arm member bottom portions being spaced downward from said first arm member bottom portions so that said corner protector can be easily installed by hand on a cabinet corner to shield the corner from damage, and said second arm members being positioned at an obtuse angle to one another.

2. A corner protector according to claim 1, wherein said first pair of arm members are rigid arm members and said second pair of arm members are resilient arm members.

3. A corner protector according to claim 1, further comprising:

a first ridge member connected to said top member and projecting outward therefrom, said ridge member configured to further shield said cabinet corner when installed thereon.

4. A corner protector according to claim 1, wherein said corner protector is integrally formed of polymeric material.

5. A corner protector according to claim 4, wherein said corner protector is formed from injection molded thermoplastic material.

6. A corner protector useful for shielding the corner of a cabinet from damage, said corner protector comprising:

a top member having an outer portion, an inner portion, and a generally flat planar bottom portion;

a first pair of arm members connected to said top member outer portion and projecting downward therefrom, with said first pair of arm members being positioned substantially perpendicularly to one another, each of said first arm members having a generally flat planar bottom edge portion oriented substantially parallel with one another and substantially parallel with said top member bottom portion;

a rigid post connected to said top member bottom portion at a position spaced apart from each member of said first pair of arm members and projecting downward therefrom;

a second pair of arm members connected to said rigid post and projecting outward therefrom, with each member of said second pair of arm members facing a corresponding member of first pair of arm members, with said second pair of arm members being positioned at an obtuse angle to one another, and with each of said second pair of arm members having a generally flat planar bottom edge portion oriented substantially parallel with one another and substantially parallel with said top member bottom portion;

wherein said first pair of arm members are rigid arm members and said second pair of arm members are rigid arm members, so that said resilient arm members engage said cabinet corner after installation thereon;

said second arm member bottom portions being spaced downward from said first arm member bottom portions so that said corner protector can be easily installed by hand on a cabinet corner to shield the corner from damage.

7. A corner protector according to claim 6, further comprising:

a first ridge member connected to said top member and projecting outward therefrom, said ridge member configured to further shield said cabinet corner when installed thereon.

8. A corner protector according to claim 7, wherein said first ridge member is a continuous ridge member formed along the entire circumference of said top member.

9. A corner protector according to claim 8, further comprising at least one second ridge member connected to said top member and projecting outward therefrom, said second ridge member having a pair of end portion, with each of said second ridge member end portions connected to said first ridge member at opposite facing positions.

10. A corner protector according to claim 6, wherein said first arm members each have an outer portion, said corner protector further comprising a bumper member connected to each of said outer portion, said bumper members configured to further shield said cabinet corner when installed thereon.

11. A corner protector according to claim 6, wherein said corner protector is integrally formed of polymeric material.

12. A corner protector useful for shielding the corner of a cabinet from damage, said corner protector comprising:

a top member having an outer portion, an inner portion, and a generally flat planar bottom portion;

a first pair of arm members connected to said top member outer portion and projecting downward therefrom, with said first pair of arm members being positioned substantially perpendicularly to one another, each of said first arm members having a generally flat planar bottom edge portion oriented substantially parallel with one another and substantially parallel with said top member bottom portion;

a second pair of arm members connected to said top member inner portion and projecting downward therefrom, with each member of said second pair of arm members facing a corresponding member of first pair of arm members, each of said second pair of arm members having a generally flat planar bottom edge portion oriented substantially parallel with one another and substantially parallel with said top member bottom portion;

said second arm member bottom portions being spaced downward from said first arm member bottom portions so that said corner protector can be easily installed by hand on a cabinet corner to shield the corner from damage;

a shelf member interconnecting said second pair of arm members, said shelf member having a generally flat planar top portion oriented substantially parallel with said second arm member bottom portions; and a frangible junction interconnecting said second pair of arm members to said top portion;

with said second pair of arm members and said shelf portion together forming a corner brace member which can be fastened to said cabinet corner after installation of said corner protector, so that said top portion and said first arm members can together be separated from said corner brace to leave said cabinet corner unshielded and said corner brace installed in said cabinet.

13. A corner protector according to claim 12, further comprising a first ridge member connected to said top member and projecting outward therefrom, said ridge member configured to further shield said cabinet corner when installed thereon.

14. A corner protector according to claim 13, wherein said first ridge member is a continuous ridge member formed along the entire circumference of said top member.

15. A corner protector according to claim 14, further comprising at least one second ridge member connected to said top member and projecting outward therefrom, said second ridge member having a pair of end portion, with each of said second ridge member end portions connected to said first ridge member at opposite facing positions.

16. A corner protector according to claim 12, wherein said first arm members each have an outer portion, said corner protector further comprising a bumper member connected to each of said outer portion, said bumper members configured to further shield said cabinet corner when installed thereon.

17. A corner protector according to claim 12, wherein said corner protector is integrally formed of polymeric material.

18. A corner protector according to claim 17, wherein said corner protector is formed from injection molded thermoplastic material.

19. A corner protector useful for shielding the corner of a cabinet from damage, said corner protector comprising:

a top member having an outer portion, an inner portion, and a generally flat planar bottom portion;

a first pair of arm members connected to said top member outer portion and projecting downward therefrom, with said first pair of arm members being positioned substantially perpendicularly to one another, each of said first arm members having a generally flat planar bottom edge portion oriented substantially parallel with one another and substantially parallel with said top member bottom portion;

a second pair of arm members connected to said top member inner portion and projecting downward therefrom, with each member of said second pair of arm members facing a corresponding member of first pair of arm members, each of said second pair of arm members having a generally flat planar bottom edge portion oriented substantially parallel with one another and substantially parallel with said top member bottom portion;

said second arm member bottom portions being spaced downward from said first arm member bottom portions so that said corner protector can be easily installed by hand on a cabinet corner to shield the corner from damage; and a first ridge member connected to said top member and projecting outward therefrom, said ridge member configured to further shield said cabinet corner when installed thereon, said first ridge member being a continuous ridge member formed along the entire circumference of said top member.

20. A corner protector according to claim 19, wherein said first arm members each have an outer portion, said corner protector further comprising a bumper member connected to each of said outer portion, said bumper members configured to further shield said cabinet corner when installed thereon.

21. A corner protector according to claim 19, wherein said corner protector is integrally formed of polymeric material.

22. A corner protector according to claim 19, wherein said corner protector is formed from injection molded thermoplastic material.

* * * * *